United States Patent [19]

Young

[11] Patent Number: 4,899,399

[45] Date of Patent: Feb. 13, 1990

[54] INFLATABLE, DISPOSABLE BEDPAN APPARATUS AND METHOD

[76] Inventor: J. Winslow Young, 803 E. Center St., Centerville, Utah 84014

[21] Appl. No.: 314,175

[22] Filed: Feb. 22, 1989

[51] Int. Cl.[4] ..... A61G 9/00

[52] U.S. Cl. ..... 4/451; 4/450; 4/456; 4/457

[58] Field of Search ..... 4/451, 456–457, 4/450, 452–455; 297/239

[56] References Cited

U.S. PATENT DOCUMENTS

| | | | |
|---|---|---|---|
| 2,750,600 | 6/1956 | MacDonald | 4/456 X |
| 3,008,153 | 11/1961 | Coulter | 4/456 X |
| 3,418,663 | 12/1968 | Scott | 4/451 |
| 3,513,488 | 5/1970 | Oring et al. | 4/456 X |
| 3,777,317 | 12/1973 | Hoborn | 4/451 |
| 3,848,274 | 11/1974 | Oliver | 4/456 |
| 4,437,195 | 3/1984 | Mangels | 4/456 |
| 4,827,540 | 5/1989 | Stokes | 4/456 |

*Primary Examiner*—Henry K. Artis
*Attorney, Agent, or Firm*—J. Winslow Young

[57] ABSTRACT

This invention is an inflatable bedpan apparatus and method whereby an inflatable torus is mounted to a liquid-impervious base sheet. The torus is placed under the pelvis of a bed-ridden patient and inflated to create a waste collection reservoir on the base sheet. An end of the base sheet is secured at the inside bottom of a waste disposal bas so that the base sheet can be pulled into the waste disposal bag while the mouth of the waste disposal bag is held stationary. The inflatable torus includes an inflation system from a pressure vessel and a deflation port.

18 Claims, 2 Drawing Sheets

INFLATABLE, DISPOSABLE BEDPAN APPARATUS AND METHOD

BACKGROUND

1. Field of the Invention

This invention relates to bedpans and, more particularly, to an inflatable, disposable bedpan apparatus and method whereby the bedpan can be inflated after placement under a patient and, after use, withdrawn from under the patient directly into an integral bag for immediate disposal.

2. The Prior Art

Bedpans have been used for over one hundred years in the care of bed-ridden persons for the purpose of collecting human waste (feces and urine) for subsequent disposal. Conventional bedpans are fabricated from metal or rigid plastic and are intended for reuse after being suitably flushed and cleansed. Healthcare institutions such as hospitals and nursing homes even have special apparatus for the flushing and cleansing of bedpans. The waste-containing bedpan is tilted into the apparatus and a lever is actuated to initiate the surge of water that flushes and cleanses the bedpan. Nursing personnel universally detest the entire procedure of human waste collection and disposal not only because of the sight and smell of the collected waste but also because the flushing of the bedpan results in considerable splashing of waste-contaminated water. This latter problem has resulted in a proliferation of alternative means of human waste disposal particularly in light of the emerging concern with the spread of the dangerous virus known to cause the dread disease AIDS (Acquired Immune Deficiency Syndrome).

Alternatives to the reusable bedpan include disposable liners for existing bedpans, disposable bedpans, and even diapers. For example, the patent of Presseisen (U.S. Pat. No. 3,061,840) discloses an inflatable, disposable bedpan having a disposable liner therein. The liner can be tied off like a bag and discarded so that the inflatable portion is reusable by the patient with a new, disposable liner placed therein. Another disposable body waste receptacle is shown by Scott (U.S. Pat. No. 3,418,663) and discloses a disposable body waste receptacle having an inflatable ring and a waste collection pouch to one side of the ring.

Another disposable bedpan having an inflatable ring is shown by Oring, et al. (U.S. Pat. No. 3,513,488). The disposable bedpan of this invention includes a ring-shaped, inflatable cushion encircling a waste-receiving receptacle. An attached flap serves as a urine shield as well as a cover for the human waste deposited in the bedpan. This particular bedpan is intended for being flushed after use then deflated, folded and stored for subsequent disposable.

Another disposable bedpan is that shown by Oden, et al. (U.S. Pat. No. 3,605,128) wherein an inflatable ring is mounted to a liquid impervious sheet, the sheet serving as a bag that can be folded up over the bedpan for subsequent disposable. A partially disposable, inflatable bedpan is shown by Avoy (U.S. Pat. No. 3,609,771) wherein a nondisposable, inflatable, U-shaped cushion is used in conjunction with a disposable body waste receptacle removably secured within the confines of the U-shaped cushion.

The reference of Scott, et al. (U.S. Pat. No. 3,906,555) discloses a disposable liner for a bedpan, the liner including an enlarged plastic sack into which a bedpan is inserted. After use, the disposable bag is turned inside out to act as a container for the human waste. A similar feature is shown by Oberstein (U.S. Pat. No. 4,136,798) wherein a bedpan is inserted into a flushable, bedpan bag.

From the foregoing it is clear that a number of attempts have been made to provide an economical, sanitary, convenient means of disposing of human waste collected from a bed-ridden patient. However, with very few exceptions, these devices are intended for use in conjunction with conventional flushing systems for disposing of the human waste through the existing sewage disposal system. Unfortunately, all of these devices require excessive handling and unnecessary exposure of the nursing personnel to risk of contamination by the human waste. What is needed is a simple, economical system for the collection and disposal of human waste that completely avoids the necessity of flushing or otherwise attempting to direct the human waste into the sewage system. What is needed is a simple, easily used system for placing a bedpan under a patient and subsequently removing the bedpan while simultaneous withdrawing the bedpan into a plastic bag for subsequent disposal of a bedpan and human waste collected therein. Such a novel apparatus and method is disclosed and claimed in the present invention.

BRIEF SUMMARY AND OBJECTS OF THE INVENTION

The present invention relates to a novel bedpan apparatus and method whereby an inflatable torus is mounted to a plastic sheet and serves as the bedpan when inflated under the patient. After use, the bedpan and supporting plastic sheet are withdrawn directly into an integral plastic bag for immediate disposal into the infectious waste disposal system. A plastic pressure vessel is integrally connected to the inflatable torus of the bedpan to allow the nursing personnel to quickly and easily inflate the bedpan after it has been placed underneath the patient.

It is, therefore, a primary object of this invention to provide improvements in disposable bedpan apparatus.

Another object of this invention is to provide improvements in the method of collecting and disposing of human waste.

Another object of this invention is to provide an inflatable, disposable bedpan whereby the bedpan can be inserted underneath a patient, inflated for use and then withdrawn directly into an integral, disposable bag.

Another object of this invention is to provide an integral disposal bag for an inflatable, disposable bedpan whereby the bedpan is retracted directly into the disposal bag after use.

These and other objects and features of the present invention will become more fully apparent from the following description taken in conjunction with the accompanying drawing and appended claims.

DETAILED DESCRIPTION OF THE PREFERRED EMBODIMENTS

Figure 1:
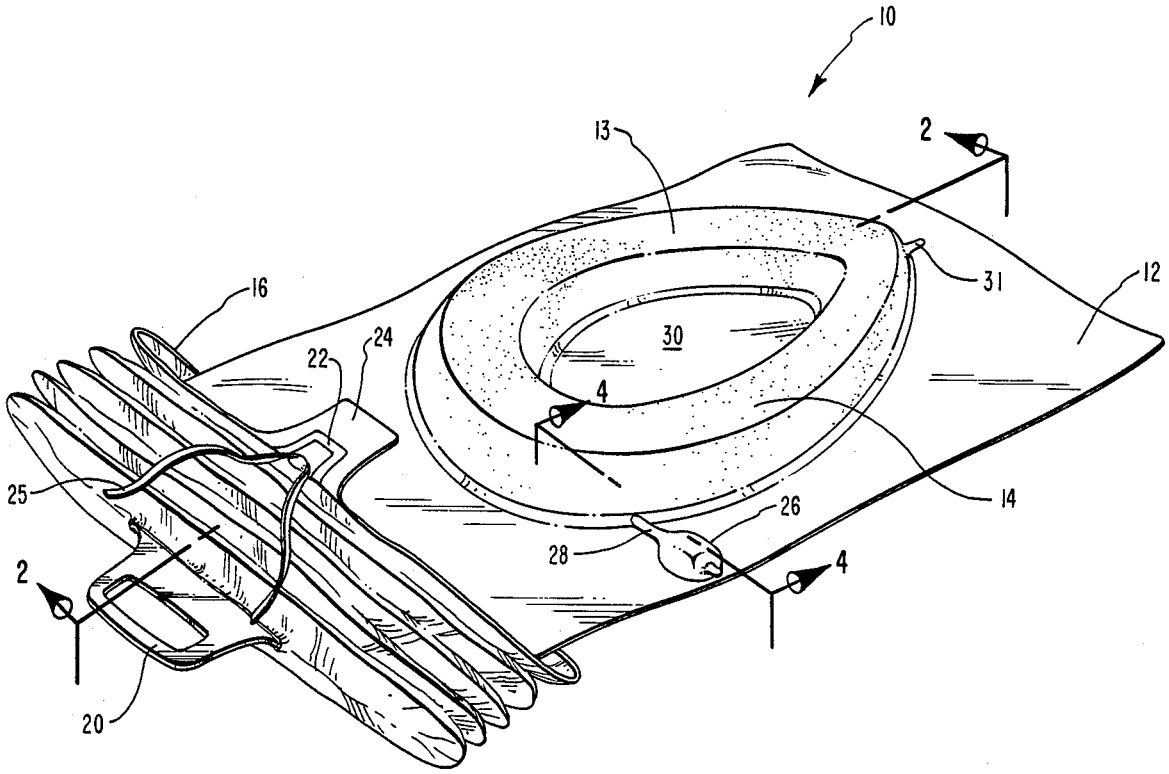
FIG. 1 is a perspective view of a presently preferred embodiment of the novel bedpan apparatus of this invention.

The invention is best understood by reference to the drawing wherein like parts are designated by like numerals throughout and taken in conjunction with the following description and appended claims.

General Discussion

Referring now more particularly to FIG. 1, the novel, bedpan apparatus of this invention is shown generally at 10 and includes a base sheet 12, having an inflated torus 14 secured thereto, and an integral, waste disposal bag 16 attached to the end of base sheet 12. An inflation member 26 is attached to inflatable torus 14 to inflate the same. When inflated, inflatable torus 14 in conjunction with base sheet 12 forms a human waste receiving receptacle 30 in its internal confines. A velour surface 13 covers the upper surface of inflatable torus 14. Inflatable torus 14 also includes an inflation device inside enclosure 26 and connected to inflatable torus 14 by a flexible tube 28. A deflation nipple 31 is located at the other end of inflatable torus 14.

Waste disposal bag 16 is fabricated from a liquid impervious plastic and has sufficient dimensions to loosely enclose all of base sheet 12 and the attached, inflatable torus 14. Importantly, the joinder between base sheet 12 and waste disposal bag 16 is sufficiently secure so that there is no leakage of human waste when the entire assembly of base sheet 12 and inflatable torus 14 is retracted into waste disposal bag 16.

Figure 5:
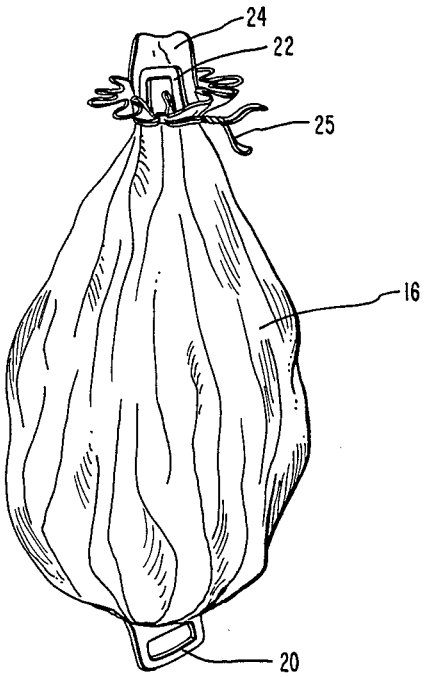
FIG. 5 is a perspective view of the inflatable, disposable bedpan enclosed in the disposal bag.

Waste disposal bag 16 includes a forward handle 22 with an accompanying shield 24 for the purpose of holding open the mouth of waste disposal bag 16 while base sheet 12 is retracted into waste disposal bag 16 upon pulling on a second handle 20. Shield 24 protects the hand of the operator (not shown) while grasping handle 22 since the human waste (not shown) collected in receptacle 30 will pass thereunder during the retraction procedure. A bag tie 25 is provided adjacent handle 22 so as to accommodate tieing off of waste disposal bag 16 when base sheet 12, inflatable torus 14 and the human waste in waste receptacle 30 are safely enclosed inside waste disposal bag 16. The relationship of bag tie 25 in typing off waste disposal bag 16 and with handle 22 is more clearly demonstrated in FIG. 5.

Figure 2:
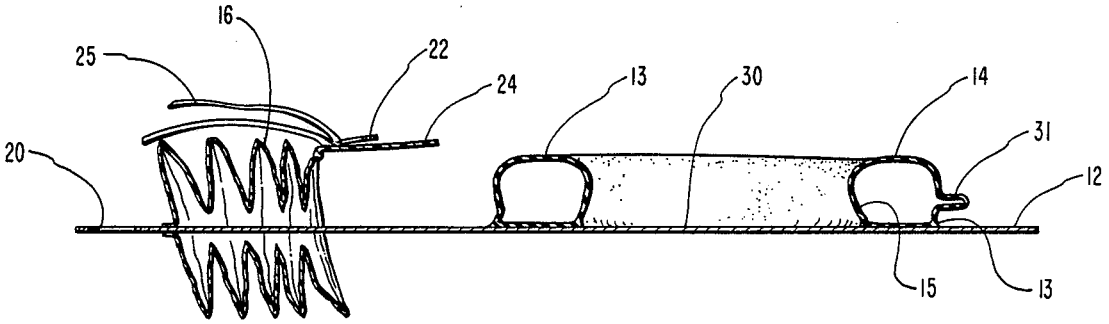
FIG. 2 is a cross-sectional view taken along lines 2—2 of FIG. 1.

Referring now more particularly to FIG. 2, the relationship between inflatable torus 14 and base sheet 12 is more clearly shown wherein they cooperate to create waste receptacle 30. The disposal of bedpan apparatus 10 is easily accomplished by the operator grasping handle 22, while generally maintaining the spatial position of handle 22, pulling handle 20 to the left to retract base sheet 12, inflatable torus 14, and the human waste (not shown) in waste receptacle 30 into the confines of waste disposal bag 16. In this manner, the human wastes thus collected are quickly and aesthetically concealed within the confines of waste disposal bag 16 with minimal exposure of any human waste to the operating personnel (not shown). Not only is this procedure simple, and aesthetically acceptable, but i is substantially safer since there is no requirement to flush or otherwise transfer the human wastes from waste receptacle 30 to any kind of toilet or other flushing device which would be used to remove the human waste into the sewage system.

Figure 3:
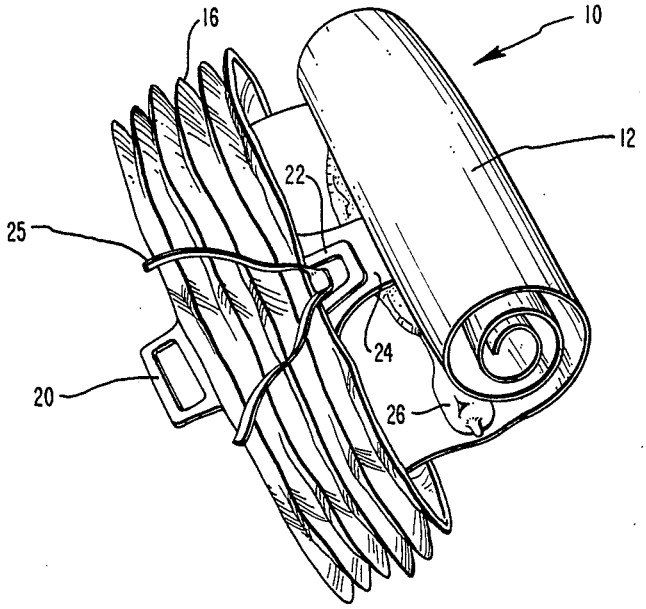
FIG. 3 is a perspective view of the novel bedpan apparatus shown in FIG. 1 with the bedpan portion deflated and the supporting sheet in the partially deployed configuration from its storage configuration.

Referring now to FIG. 3, the deflated, inflatable torus 14 (FIGS. 1, 2 and 4) is rolled up inside base sheet 12. Base sheet 12 is rolled toward waste disposal bag 16 to present a compact bundle for storage of inflatable, disposable bedpan 10. For ease of illustration, inflatable, disposable bedpan 10 is shown in the partially deployed state to more clearly illustrate the interrelationship between the various components. Importantly, waste disposal bag 16 is shown folded or otherwise collapsed adjacent handle 20 so that it does not need to be removed from inflatable torus 14 after base sheet 12 has been unrolled. Once unrolled, base sheet 12 provides the support structure for placement of inflatable torus 14 in its deflated condition under a patient (not shown). The deployed and inflated state being shown in FIG. 1.

Figure 4:
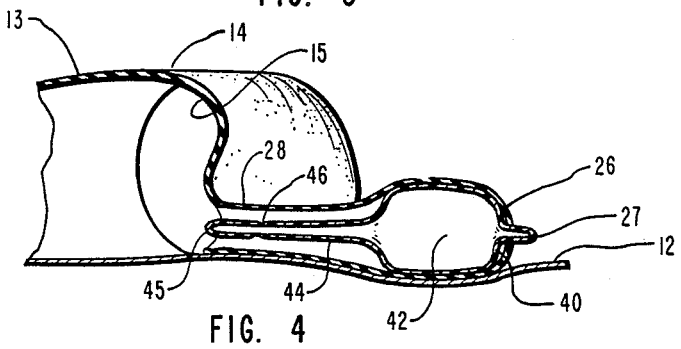
FIG. 4 is an enlarged, partial cross-section view taken along lines 4—4 of FIG. 1.

Referring now more particularly to FIG. 4, the inflation apparatus for this invention is shown. In particular, after placement of inflatable torus 14 in its deflated state underneath a patient (not shown) the operating personnel (not shown) inject a compressed gas 42 from a pressure vessel 40 into interior chamber 15 of inflatable torus 14. Pressure vessel 40 contains a preselected volume of pressurized gas such as nitrogen, carbon dioxide, or the like. Pressure vessel 40 includes an extension 44 having a frangible section 46 and a nipple 45 on the end thereof. All of pressure vessel 40 is sealingly enclosed within a flexible enclosure 26 extending by a tube 28 from a sidewall of inflatable torus 14. To inflate inflatable torus 14, the operator (not shown) grasps tube 28 and bends the same breaking frangible sector 46 to release compressed gas 42 into cavity 15. The preselected quantity of compressed gas 42 is sufficient to inflate inflatable torus !4 to elevate the patient (not shown) to thereby provide the desired configuration for bedpan apparatus 10 and, more particularly, the creation of the waste receptacle 30 therein.

Once inflated, inflatable, disposable bedpan apparatus 10 is used as a conventional bedpan for the receipt of human waste (not shown) into waste receptacle 20. After use and after the patient (not shown) has been suitably cleansed, all of the cleansing tissues, etc., (not shown) are discarded into receptacle 30 by the nursing personnel (not shown). Immediately thereafter the nursing personnel grasps handle 22 with one hand and, while holding handle 22 in a stationary position, grasps handle 20 with the other hand and upon pulling handle 20 to the left retracts base sheet 12 into the confines of waste disposal bag 16 with minimal exposure of the contents of waste receptacle 30 to the atmosphere, or even the sight of the nursing personnel. Thereafter, the mouth of waste disposal bag 16 is constricted below handle 22 and bag tie 25 is secured therearound to tie off the same for subsequent disposal. If desired, nipple 31 on the end of inflatable torus 14 may be severed to deflate inflatable torus 14 so as to reduce the total volume within waste disposal bag 16. Advantageously, this procedure can occur immediately prior to closing off the mouth of disposal bag 16 so that there is minimal chance of exposure of the human waste in waste receptacle 30 to the operating personnel (not shown).

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An inflatable, disposable bedpan comprising:

a base sheet for placement under a patient, said base sheet being fabricated from a liquid-impervious material;

an inflatable torus mounted to said base sheet;

inflation means connected to said inflatable torus for selectively inflating said inflatable torus;

a waste disposal bag mounted to an end of said base sheet, said waste disposal bag receiving said base sheet and said inflatable torus for disposal, said waste disposal bag comprising a mouth at first end and a closed end at second end, said waste disposal bag including a first handle means at said first end for hand grasping said first end of said waste disposal bag and a second handle means at said second for hand grasping said second end of said waste disposal bag along with an end of said base sheet, said second handle means providing a handle for pulling said base sheet and said inflatable torus into said waste disposal bag while holding said first handle means at a generally fixed position and holding said mouth open with said first handle means.

2. The inflatable, disposable bedpan defined in claim 1 wherein said base sheet and said inflatable torus in a deflated condition are rolled up toward said waste disposal bag to provide a compact bundle for storage and handling.

3. The inflatable, disposable bedpan defined in claim 2 wherein said base sheet and said inflatable torus are rolled up against and around said inflation means and said waste disposal bag.

4. The inflatable, disposable bedpan defined in claim 1 wherein said inflatable torus creates a liquid reservoir on said base sheet when said inflatable torus is inflated by said inflation means.

5. The inflatable, disposable bedpan defined in claim 4 wherein said inflatable torus includes a deflation port for selectively deflating said inflatable torus.

6. The inflatable, disposable bedpan defined in claim 1 wherein said inflation means comprises a pressure vessel in fluid communication with said inflatable torus, said pressure vessel containing a pressurized gas and having a valve means for selectively releasing said pressurized gas into said inflatable torus.

7. The inflatable, disposable bedpan defined in claim 6 wherein said valve means comprises a frangible sector on said pressure vessel.

8. The inflatable, disposable bedpan defined in claim 6 wherein said pressure vessel comprises a plastic body.

9. The inflatable, disposable bedpan defined in claim 1 wherein said first handle means includes a bag tie means for tieing closed said mouth of said waste disposal bag.

10. The inflatable, disposable bedpan defined in claim 1 wherein said first handle means includes a shield means for shielding said first handle means from contents collected inside said inflatable torus.

11. The inflatable, disposable bedpan defined in claim 1 wherein said inflatable torus comprises a velour surface on at least an upper surface.

12. An inflatable bedpan apparatus comprising:

a liquid impervious base sheet, said base sheet having sufficient dimensions to reside under the pelvic portions of a human;

an inflatable torus mounted to said base sheet so as to create a waste receptacle on said base sheet when said inflatable torus is inflated;

a waste disposal bag mounted to said base sheet with an end of said base sheet secured inside said waste disposal bag adjacent the bottom of said waste disposal bag, said waste disposal bag enclosing said base sheet and said inflatable torus when said base sheet and said inflatable torus are retracted inside said waste disposal bag;

inflation means connected to said inflatable torus for selectively inflating said inflatable torus; and handle means for holding said waste disposal bag open and retracting said base sheet and said inflatable torus into said waste disposal bag.

13. The inflatable bedpan apparatus defined in claim 12 wherein said inflatable torus includes a velour on an upper surface and a deflation port.

14. The inflatable bedpan apparatus defined in claim 12 wherein said inflation means comprises a plastic pressure vessel sealingly enclosed in fluid communication with said inflatable torus in a flexible chamber and having a frangible sector that can be selectively broken to release pressurized gas from said plastic pressure vessel upon bending said flexible chamber.

15. The inflatable, disposable bedpan defined in claim 12 wherein said waste disposal bag comprises a mouth at a first end and a closed end at a second end, said waste disposal bag including a first handle means at said first end for hand grasping said first end of said waste disposal bag and a second handle means at said second end for hand grasping said second end of said waste disposal bag along with an end of said base sheet, said second handle means providing a handle for pulling said base sheet and said inflatable torus into said waste disposal bag while holding said first handle means at a generally fixed position and holding said mouth open with said first handle means.

16. A method for collecting human waste with a bedpan and disposing of said bedpan comprising:

preparing a disposable bedpan by mounting an inflatable torus to a base sheet, both of said inflatable torus and said base sheet being fabricated from a liquid-impervious material;

obtaining a waste disposal bag large enough to receive therein through a mouth thereof said base sheet and said inflatable torus and attaching a first end of said base sheet to the inside bottom of said waste disposal bag;

collapsing said waste disposal bag toward said first end of said base sheet;

placing said base sheet and said inflatable torus under the pelvis of a patient;

inflating said inflatable torus thereby raising said pelvis and creating a waste collection reservoir under said pelvis;

collecting waste in said waste collection reservoir; and withdrawing said base sheet and said waste collection reservoir from under said pelvis and into said waste disposal bag by pulling said base sheet at said first end while holding open said waste disposal bag.

17. The method defined in claim 16 wherein said obtaining step comprises preparing a first handle and a second handle on said waste disposal bag, said first handle being located on said bottom of said waste disposal bag to accommodate pulling said base sheet into said waste disposal bag, said second handle being located adjacent said mouth of said waste disposal bag, said second handle holding said mouth open.

18. The method defined in claim 16 wherein said withdrawing step comprises deflating said inflatable torus after said inflatable torus has been enclosed in said waste disposal bag.

* * * * *